United States Patent [19]

Bruski et al.

[11] Patent Number: 5,076,340

[45] Date of Patent: Dec. 31, 1991

[54] CAST COMPOSITE MATERIAL HAVING A MATRIX CONTAINING A STABLE OXIDE-FORMING ELEMENT

[75] Inventors: Richard S. Bruski, Encinitas; Larry G. Hudson, Carlsbad; Michael D. Skibo, Leucadia, all of Calif.

[73] Assignee: Dural Aluminum Composites Corp., San Diego, Calif.

[21] Appl. No.: 516,341

[22] Filed: Apr. 30, 1990

Related U.S. Application Data

[62] Division of Ser. No. 391,087, Aug. 7, 1989, Pat. No. 4,943,490.

[51] Int. Cl.[5] ..... B22D 19/14

[52] U.S. Cl. ..... 164/97

[58] Field of Search ..... 164/97

[56] References Cited

U.S. PATENT DOCUMENTS 4,759,995 7/1988 Skibo et al. ..... 428/614

4,871,008 10/1989 Dwivedi et al. ..... 164/97

FOREIGN PATENT DOCUMENTS 56-141960 11/1981 Japan ..... 164/97

61-262448 11/1986 Japan .

*Primary Examiner*—Kuang Y. Lin

*Attorney, Agent, or Firm*—Gregory Garmong; James A. Rich; Gordon P. Becker

[57] ABSTRACT

A cast composite material is prepared from a modified aluminum-containing matrix and reinforcement particles mixed into the matrix. From about 15 to about 130, preferably from about 20 to about 50, parts per million of an element, preferably beryllium, that forms a more stable oxide than magnesium oxide is included in the matrix alloy. The stable-oxide-forming element reduces the amount and thickness of the aluminum oxide and other oxides formed at the surface of the melt, which otherwise may be mixed into the melt to cause microstructural irregularities in the matrix of the cast composite material.

8 Claims, 2 Drawing Sheets

CAST COMPOSITE MATERIAL HAVING A MATRIX CONTAINING A STABLE OXIDE-FORMING ELEMENT

This is a division of application Ser. No. 07/391,087, filed 8/7/89, now U.S. Pat. No. 4,943,490.

BACKGROUND OF THE INVENTION

This invention relates to a cast metal-matrix composite material, and, more particularly, to a chemical modification to the matrix of such a material that improves its microstructure.

Reinforced metal matrix composite materials have gained increasing acceptance as structural materials. Metal matrix composites typically are composed of reinforcing particles such as fibers, grit, powder or the like that are embedded within a metallic matrix. The reinforcement imparts strength, stiffness and other desirable properties to the composite, while the matrix protects the reinforcement and transfers load within the composite piece. The two components, matrix and reinforcement, thus cooperate to achieve results improved over what either could provide on its own.

Twenty years ago, reinforced composite materials were little more than laboratory curiosities because of very high production costs and their lack of acceptance by product designers. More recently, great advances in the production of nonmetallic composite materials, such as graphite-epoxy composite materials, have been made, with a significant reduction of their cost. During that period, the cost of metal-matrix composite materials remained relatively high.

In the last several years, the discovery of a processing technology that permits the reproducible production of large quantities of cast reinforced composite materials with metal matrices has significantly reduced the cost of these materials. See, for example, U.S. Pat. No. 4,759,995 and U. S. Pat. No. 4,786,467, whose disclosures are incorporated by reference.

Since the discovery of the methods of the '995 and '467 patents, many applications for such materials have been developed, and their volume of use has increased significantly so that they have become a major new class of structural material. These cast metal matrix composite materials offer the property improvements of composite materials at little more than the cost of conventional monolithic materials. Even with recent cost reductions, nonmetallic matrix composite materials remain significantly more costly to produce than monolithic materials and the cast composite materials. The cast composite materials may be used at elevated temperatures or under other conditions that preclude the use of nonmetallic matrix composite materials.

However, it has been found that in some instances the microstructures of the metal matrix composite materials produced by casting include various types of irregularities that interfere with their post-casting fabrication and use. For example, agglomerations of reinforcement particles with other solids have sometimes been observed in the matrix of the cast, solidified material. The agglomerations cause reductions in the general property levels of the composite material due to the reduction in the reinforcement level in other regions and increased inhomogeneity of the structure, and also can be the sites for the initiation of premature failure of the composite material in loading.

There exists a need for a modification to the preparation of cast composite materials that reduces microstructural irregularities, and results in a more uniform structure. The present invention fulfills this need, and further provides related advantages.

SUMMARY OF THE INVENTION

The present invention provides an improved cast composite material and a method for its preparation. The composite material of the invention does not exhibit agglomerations of reinforcement particles such as observed in some prior matrices, leading to a more uniform microstructure and better properties. The approach of the invention requires only a minor change to the prior fabrication procedure.

In accordance with the invention, a composite material comprises a matrix of an aluminum-containing alloy, the matrix further containing from about 15 to about 130 parts per million by weight of an oxide-forming element that forms an oxide more stable than magnesium oxide; and a reinforcement material distributed through the matrix. The oxide-forming element is preferably beryllium, lanthanum, thorium, scandium, or yttrium, and is preferably present in an amount of from about 20 to about 50 parts per million. The reinforcement material is preferably aluminum oxide or silicon carbide, in an amount of from about 5 to about 30 volume percent of the composite material. Magnesium is also commonly included in the matrix alloy.

In accordance with a processing aspect of the invention, a method for preparing a composite material comprises the steps of furnishing a matrix alloy containing aluminum, and further containing from about 15 to about 130 parts per million by weight of an oxide forming element selected from the group consisting of beryllium, lanthanum, thorium, scandium, and yttrium; furnishing particles of a reinforcement material; melting the matrix alloy; adding the particles of the reinforcement material to the molten matrix alloy; mixing together the molten matrix alloy and the particles of the reinforcement material to wet the matrix alloy to the particles, while minimizing the introduction of any gas into and minimizing the retention of any gas within, the mixture; and casting the resulting mixture.

In the absence of the stable-oxide-forming element, a small amount of elongated stringers of stable oxides of aluminum, magnesium, and possibly other metallic elements are sometimes formed during the mixing of the molten matrix alloy and the reinforcement. These oxides form primarily as skins on the surface of the melt. During the mixing of the reinforcement into the matrix, the oxide skins are broken up to form the stringers, which are distributed throughout the volume of the mixture. These stringers are somewhat larger than the typical size of the reinforcement particles. Some of the reinforcement particles adhere to the oxide stringers, resulting in agglomeration of the particles with the stringers. These agglomerations cause a segregation of the reinforcement, which prevents the wetting of the reinforcement particles by the matrix and depletes the remainder of the composite material of reinforcement particles, reducing its strength. The agglomerations also contribute to the formation of stress concentrations that may lead to premature failure of the composite material in service.

The oxide-forming element forms a thin oxide skin on the surface of the melt in preference to that normally formed by the aluminum, magnesium, and other metallic elements on the surface of the melt. Thus, any oxide-forming element having an oxide with a more negative free energy of formation than magnesium is operable. Such elements include beryllium, thorium, lanthanum, scandium, and yttrium. Beryllium is preferred because of cost and manufacturing considerations.

In the case of beryllium, the most preferred oxide forming element, a thin layer or skin of beryllium oxide (BeO) is formed at the surface of the melt in preference to the usual oxide. Even if the beryllium oxide breaks up and is mixed into the melt, there is less tendency for the reinforcement particles to agglomerate at the oxide because the beryllium oxide skin is very thin. The cast and solidified composite material with an aluminum-containing matrix, but with the addition of the stable oxide forming element, therefore does not exhibit the agglomerations of particles characteristic of the unmodified composite material.

The amount of the oxide forming element should be sufficient to form its oxide in preference to the aluminum, magnesium, and other metallic oxides, but not so large as to interfere with the fluidity or castability of the material. At least about 15, and preferably at least 20, parts per million by weight (ppm) should be present in the matrix alloy. Lesser amounts are ineffective in removing the metallic oxide stringers from the microstructure, and consequently the agglomerations or reinforcement particles are still observed. The maximum amount of the oxide forming element is about 130, and preferably 50, parts per million by weight of the matrix alloy. Only a small amount of the oxide forming element actually forms oxide on the surface of the melt, and larger additions are wasteful and uneconomic. Moreover, in the case of beryllium, larger additions, may result in health concerns in the environment of the casting plant. Amounts of the oxide forming element greater than the indicated limits produce no improvement, and may result in somewhat deteriorated castability of the composite material.

The present invention provides an important advance in the art of castable metal matrix composite materials. A small addition to an aluminum matrix melt of an element that has an oxide more stable than magnesium oxide reduces the incidence of agglomeration of reinforcement particulate, and a more uniform microstructure. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
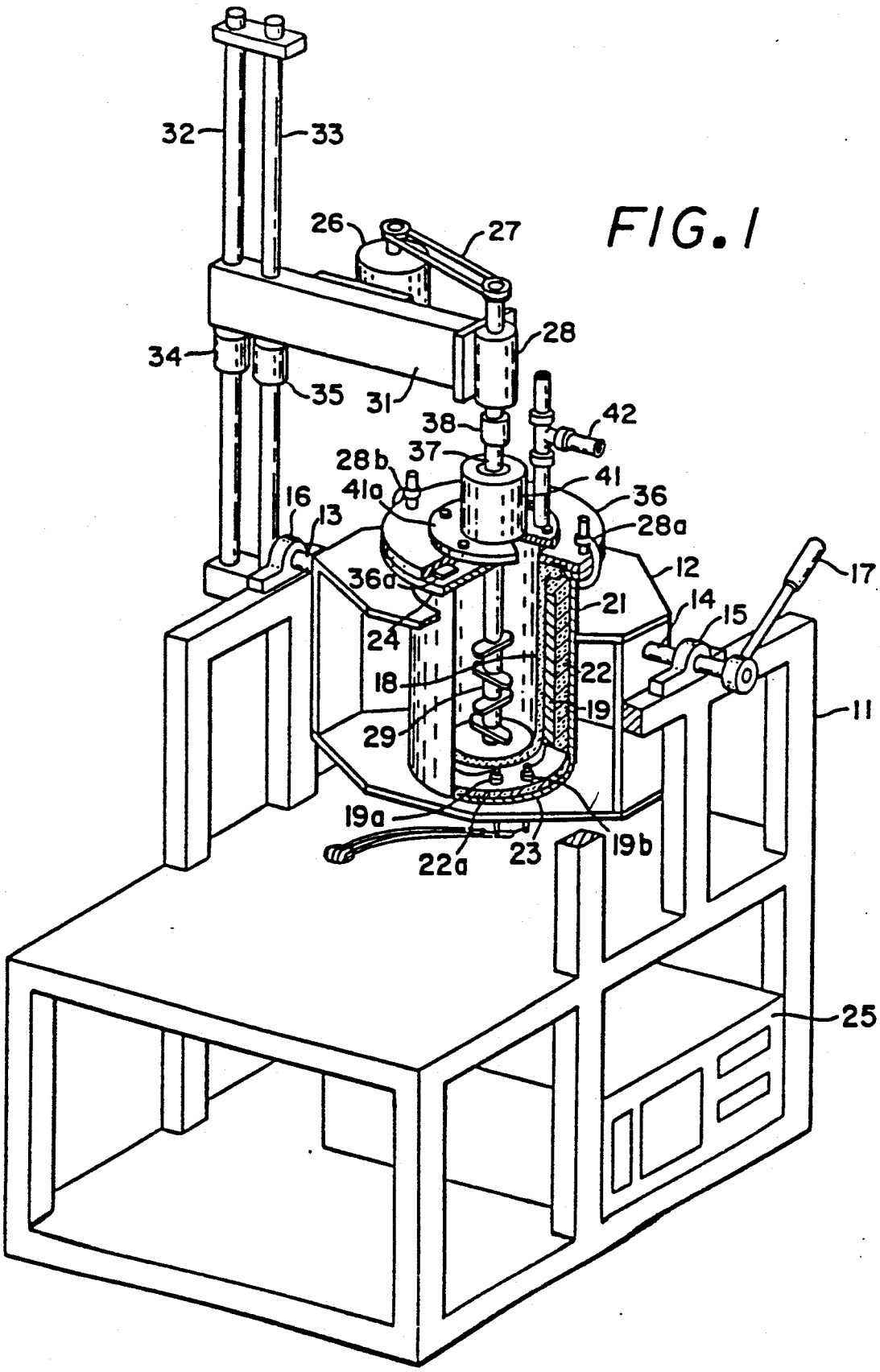
FIG. 1 is a perspective view of the mixing apparatus using a dispersing impeller, with portions broken away for clarity.

Apparatus for preparing a composite material by casting is illustrated in FIG. 1. (The discussion of the apparatus is provided by way of background, as the casting apparatus does not itself form part of the present invention.) Referring to FIG. 1, the apparatus comprises a metal stand 11, upon which is supported a rotatable furnace holder 12. The furnace holder 12 is equipped with shafts 13 and 14 secured thereto, that are in turn journaled to pillow blocks 15 and 16. A handle 17 secured to shaft 16 is used to rotate the holder 12 as described for melting or casting.

A crucible 18 is formed of a material which is not substantially eroded by the molten metal. In one embodiment, the crucible 18 is formed of alumina and has an inside diameter of 3¾ inches and a height of 11 inches. This crucible is suitable for melting about 5 pounds of aluminum alloy. The crucible is resistively heated by a heater 19, such as a Thermcraft No. RH274 heater. The heated crucible is insulated with Watlow blanket insulation 22 and a low density refractory shown at **22*a*. The insulated assembly is positioned inside a 304 stainless steel pipe which has a ¼ inch thick solid base 23 and a top flange 24 welded thereto, to form container 21. Container 21 serves not only as a receptacle for crucible 18, but also functions as a vacuum chamber during mixing. The power for heater 19 is brought through two Varian medium power vacuum feedthroughs 19*a* and 19*b*. Two type K thermocouples positioned between crucible 18 and heater 19 are used for temperature monitoring and control, and are brought into container 21** with Omega Swagelock-type gas-tight fittings (not shown).

The temperature of crucible 18 is controlled with an Omega 40 proportional controller 25 which monitors the temperature between the crucible and the heater. Controller 25 drives a 60 amp Watlow mercury relay, which switches 215 volts to heater 19, the temperature being monitored with a Watlow digital thermometer.

The mixing assembly consists of a ¼ horsepower Bodine DC variable speed motor 26 controlled by a Minarik reversible solid state controller (not shown). The motor 26 is secured to an arm 31 and is connected by cog belt 27 to a ball bearing spindle 28 which is supported over the crucible 18 and holds the rotating dispersing impeller 29.

The spindle 28 is secured to the arm 31 which is slidingly connected to supports 32 and 33 to permit vertical movement of the arm 31. Clamps 34 and 35 can be locked to secure arm 31 in the position desired.

The dispersing impeller 29 is machined from 304 stainless steel and welded together as necessary, bead blasted, and then coated with Aremco 552 ceramic adhesive. The coated impeller 29 is kept at 200° C. until needed. The dispersing impeller 29 is positioned vertically along the centerline of the crucible. When larger crucibles are used, the particulate tends to collect at the surface of the outer periphery of the melt and may not be mixed into the melt unless it is forced from the wall toward the center of the melt and moved toward the dispersing impeller 29. In that case, a sweeping impeller (not shown) may be used to force particulate away from the walls and under the influence of the dispersing impeller.

A removable metal flange 36 covers the container 21, with a gasket **36*a* between the upper flange of the container 21 and the flange 36, and can be sealed in an airtight manner by clamps 28*a* and 28*b*. A shaft 37 is releasably secured to spindle 28 by means of a chuck 38 and passes through vacuum rotary feed-through 41, equipped with a flange 41*a***.

A port 42 equipped with a tee-fitting in flange 41*a* permits ingress and egress of argon from a source (not shown), and is adapted for application to a vacuum line to permit evacuation of the crucible 18.

In the general approach to preparing the preferred composite material of from about 5 to about 30 volume percent silicon carbide or aluminum oxide reinforcement particulate in an aluminum alloy matrix, the heater is activated and the controller set so that the temperature is above the liquidus of the matrix alloy. The matrix alloy is placed into the crucible and melted. The temperature is thereupon reduced somewhat and the melt is blown with argon by bubbling the gas through the melt, prior to the addition of the particulate material. Silicon carbide or aluminum oxide particulate is then added to the melt, the mixing assembly put in place, a vacuum pulled, and mixing begun. Periodically the chamber is opened to permit cleaning of the crucible walls, if necessary, while maintaining an argon cover over the surface of the melt. After sufficient mixing has occurred, the molten composite material is cast into a form or mold by any appropriate procedure.

The present invention is concerned in part with the composition of the matrix alloy used in preparing the cast composite material. The matrix alloy is aluminum-based, with most of the alloy being aluminum. The matrix alloy often contains at least some magnesium, which is an important and widely used alloying ingredient in both aluminum casting alloys and aluminum wrought alloys. The matrix may contain other principal alloying elements in substantial amounts, such as, for example, copper, silicon, manganese, iron, or titanium, in amounts from a tenth of a percent up to 10 percent or even more. The magnesium and other principal alloying elements provide strength, toughness, workability, castability, and other required properties.

No limitation on the type or amounts of the major or minor alloying ingredients of the matrix is known. Some common aluminum alloys operable with this invention include 1000, 2000, 6000, and 7000 series alloys. The effect of the beryllium (or other oxide former) addition is largely based in its physical effect on the oxide structure at the surface of the melt, and not upon any chemical interaction with the alloying elements of the matrix (or the reinforcement, for that matter). There is therefore no reason to believe that the operability of the present invention should be limited to any particular aluminum alloys, as long as there are substantial amounts of reinforcement particles present.

Aluminum, aluminum and magnesium together, and other metallic elements that are typically present in commercial alloys are oxide formers whose oxides have a negative free energy of formation. Although care is taken to outgas oxygen from the solid components of the matrix and from the reinforcement particulate prior to mixing in the crucible, and from the mixing apparatus itself, some small amount of oxygen almost always remains in the atmosphere above the melt, adhered to surfaces, or dissolved. The aluminum and other metallic species serve to getter even small amounts of oxygen, forming a thick oxide layer or skin that floats on the surface of the melt. The oxide has the beneficial effect of protecting the melt from further rapid oxidation.

However, the thick surface oxide layer has the harmful effect of breaking up into stringers during the vigorous mixing used to wet the matrix alloy to the particulate, and the stringers are distributed through the mixed alloy. As used herein, a "stringer" is a piece of surface oxide that has broken free of the surface and been mixed into the melt. The stringers are usually much larger than the individual reinforcement particles and are often elongated, thereby presenting a large surface to volume ratio. It is observed that some of the particulate reinforcement material adheres to the stringers, forming agglomerations of oxide stringer and reinforcement throughout the matrix of the molten alloy. The oxides are very stable, and unlikely to dissolve. Although the oxides mixed into the melt might otherwise eventually float on the molten melt, the presence of the reinforcement particles and the mixing action within the crucible prevent them from floating to the surface to be skimmed as a dross. In fact, it is the mixing action that tends to fracture and draw surface oxide down into the melt, forming the stringers.

Figure 2:
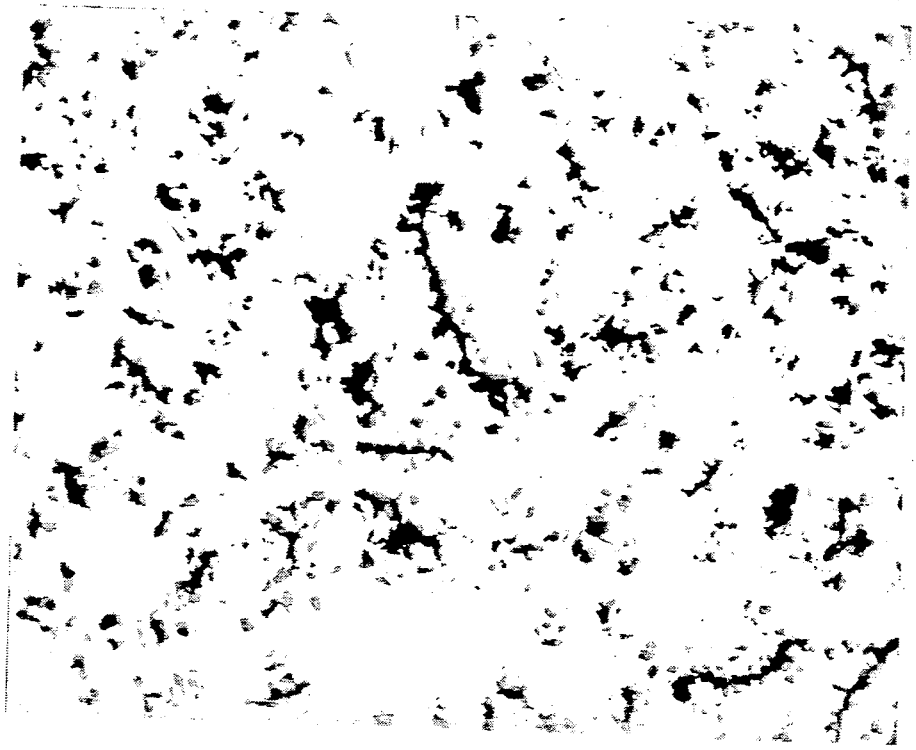
FIG. 2 is a photomicrograph of a cast composite microstructure without the addition of a stable-oxide-forming element.

The massive oxide stringers and reinforcement agglomerated thereto are mixed throughout the melt, and freeze in place when the melt is solidified. FIG. 2 is a micrograph of a cast composite material prepared from a mixture of about 15 volume percent aluminum oxide reinforcement particulate in a 2014 aluminum alloy matrix (and without any stable oxide forming element of the invention). (2014 aluminum alloy has nominal compositional limits, in weight percent, of 0.5–1.2 silicon, 1.0 iron, 3.9–5.0 copper, 0.4–1.2 manganese, 0.2–0.8 magnesium, 0.1 chromium, 0.25 zinc, 0.15 titanium, maximum 0.15 other elements, balance aluminum.) FIG. 2 illustrates dark oxide stringers with lighter colored particulate adhered to or "decorating" the stringer, in an agglomerated form, all within a light colored aluminum matrix. There are large denuded matrix regions with few reinforcement particles, between the stringers.

The type of microstructure displayed in FIG. 2 leads to a reduction of desirable properties of the composite material in at least three ways. First, the agglomeration of oxide and particulate can contribute to the prevention of the wetting of the reinforcement particulate by the molten matrix. Second, reinforcement particulate is concentrated at the oxide locations, reducing the amount of particulate reinforcement available to be distributed throughout the remainder of the melt and thence the uniformity of the reinforcement distribution. The overall composite properties in the remainder of the melt are thereby reduced. Third, the agglomeration of the oxide and the reinforcement particulate creates a source for the initiation of microcracks in the composite during loading or fatigue, which accelerates failure of the composite material.

The present approach reduces, and desirably eliminates, the formation of thick oxides of aluminum, aluminum and magnesium, and other metallic elements at the surface of the composite melt and their presence in the cast composite material. The invention provides that a small amount of a more potent oxide forming element than magnesium be added to the melt so that a thin surface oxide of the stable-oxide-forming element is preferentially formed instead of the aluminum or other thick surface oxide skin.

The most preferred oxide forming element is beryllium, in an amount of from about 20 to about 50 parts per million by weight of the matrix. Smaller amounts are significantly less effective, and amounts below about 15 parts per million are largely ineffective in avoiding the presence of the thick surface oxide. Amounts larger than about 50 parts per million tend to form thick oxides at the surface of the melt, and possibly compounds with the dross on the surface of the melt and with the reinforcement if it reacts with the oxide forming element. The molten composite material becomes difficult to cast. Above about 130 parts per million of the oxide forming element, too much oxide is formed and the castability of the alloy is reduced.

The casting of the cast composite materials that are the subject of the present invention differs significantly from the casting of monolithic, non-composite materials. The presence of the reinforcement particles, typically in amounts of about 5 to about 30 volume percent, alters the fluidity and castability of the composite material. The addition of beryllium to the composite material to form beryllium oxide on the surface of the melt results in the onset of reduced castability when the beryllium exceeds about 130 ppm. By contrast, certain non-composite aluminum alloys such as type 357 may contain from 400 to 700 ppm beryllium, but they are still castable because they do not contain reinforcement particulate. The behavior of cast composite materials containing reinforcement particles simply cannot be inferred from prior experience with monolithic, non-composite materials.

Beryllium oxide is a known hazardous material, and it is therefore preferred to maintain the beryllium content as low as possible while retaining effectiveness. The preferred range is therefore about 20 to about 50 parts per million, and the most preferred amount is 30 parts per million in commercial casting practice. If the amount of beryllium is reduced too close to the lower effectiveness limit of about 15 parts per million, there may be difficulty in ensuring that an acceptable amount of beryllium is present, under commercial casting practices.

Figure 3:
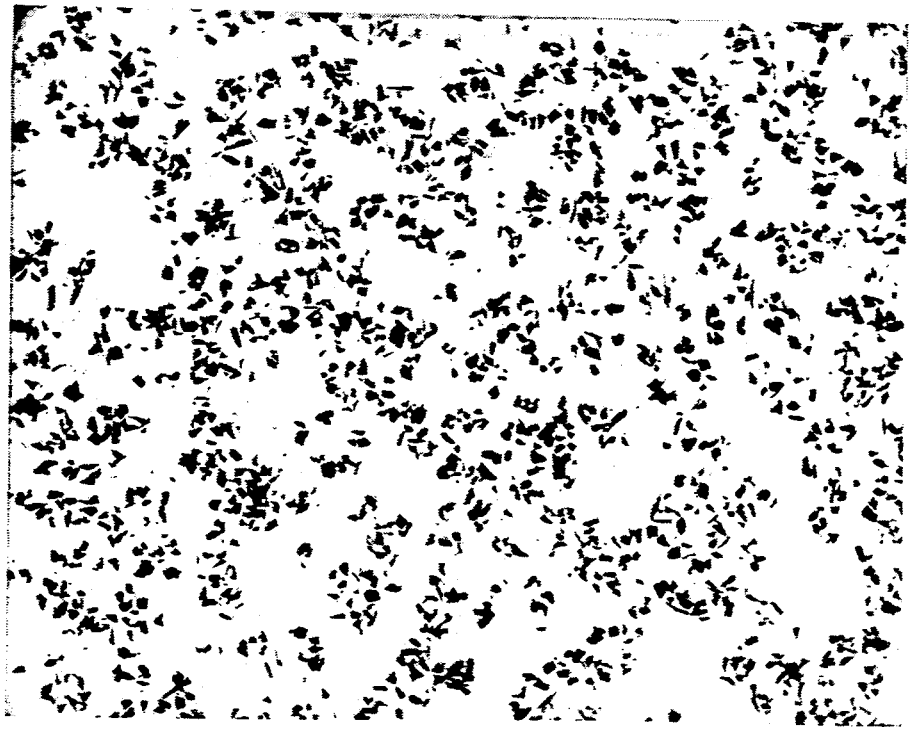
FIG. 3 is a photomicrograph of a cast composite microstructure with the addition of a stable-oxide-forming element.

FIG. 3 illustrates the microstructure of the same composite material as depicted in FIG. 2, 2014 matrix alloy with about 15 percent by volume aluminum oxide reinforcement particulate, except that about 30 parts per million of beryllium was added to the matrix alloy before the aluminum oxide particulate reinforcement was mixed into the matrix. By comparison with the microstructure of FIG. 2, it is seen that the beryllium addition has promoted a more uniform microstructure of the composite material. The massive stringers of oxide and agglomerated reinforcement particles are no longer present, nor are there denuded regions of the same size as found in the microstructure of FIG. 2.

FIGS. 2 and 3 illustrate a composite material having an aluminum oxide reinforcement particulate. Aluminum oxide is the preferred reinforcement for use with the present invention, as the beneficial effect of the stable-oxide-forming element is most pronounced for that reinforcement material. However, there is a beneficial effect for other reinforcement materials, and they are within the scope of the invention. The interaction of the reinforcement particles with the stringers is a physical reaction, and the chemical composition of the reinforcement is not limiting of the invention.

The following examples illustrate aspects of the invention, and do not limit the scope of the invention, except as to amounts of beryllium added in parts per million (ppm).

EXAMPLE 1

A series of composite materials of 15 volume percent aluminum oxide reinforcement particulate in a 2014 aluminum matrix alloy was prepared by the melting and casting approach described earlier. The composite materials differed in the amount of beryllium present in the matrix alloy. Where there was no beryllium addition, stringers were distributed throughout the composite material, and the microstructure is that of FIG. 2. Where about 15 ppm beryllium was present, there was noticeable but small improvement in the microstructure toward that shown in FIG. 3, but still having some stringers present. Composites having about 30 ppm and 50 ppm beryllium in the matrix showed excellent microstructures, of the type shown in FIG. 3. Composites having about 130 ppm also show acceptable microstructural characteristics of the type shown in FIG. 3, but there is an onset of difficulty in casting. Additionally, there is concern for possible health effects of the beryllium content of the dross remaining after casting. A composite material having 275 ppm beryllium exhibited an acceptable microstructure, but there was considerable difficulty in casting the composite material due to the thicker beryllium oxide skin.

EXAMPLE 2

Example 1 was repeated, except that the matrix alloy was 6061 aluminum alloy. The various beryllium additions were repeated, with substantially the same results.

The present invention therefore permits the preparation of a higher quality, more uniform microstructure cast composite materials than has been possible previously. Although particular embodiments of the invention have been described in detail for purposes of illustration, various modifications may be made without departing from the spirit and scope of the invention. Accordingly, the invention is not to limited except as by the appended claims.

What is claimed is:

1. A method for preparing a composite material, comprising the steps of:
   - furnishing a matrix alloy containing aluminum, and further containing from about 15 to about 130 parts per million by weight of an oxide forming element selected from the group consisting of beryllium, lanthanum, thorium, scandium, and yttrium;
   - furnishing particles of a reinforcement material;
   - melting the matrix alloy;
   - adding the particles of the reinforcement material to the molten matrix alloy;
   - mixing together the molten matrix alloy and the particles of the reinforcement material to wet the matrix alloy to the particles, while minimizing the introduction of any gas into and minimizing the retention of any gas within, the mixture; and
   - casting the resulting mixture.

2. The method of claim 1, wherein the oxide forming element is present in an amount of from about 20 to about 50 parts per million.

3. The method of claim 1, wherein the reinforcement material is selected from the group consisting of silicon carbide and aluminum oxide.

4. The method of claim 1, wherein a vacuum is applied to the melt during the step of mixing.

5. The method of claim 1, wherein the step of mixing is accomplished by a rotating impeller immersed in the melt.

6. The method of claim 1, wherein the matrix further contains magnesium.

7. The method of claim 1, wherein the reinforcement material is present in an amount of from about 5 to about 30 volume percent of the composite material.

8. The method claim 1, wherein the oxide-forming element is beryllium.

* * * * *